US005893492A

United States Patent [19]

Hanse et al.

[11] Patent Number: 5,893,492

[45] Date of Patent: Apr. 13, 1999

[54] PROCESS FOR REFUSING SLIDE GATE PLATES AND PLATE FOR THIS CLOSURE

[75] Inventors: Eric Hanse, Dour, Belgium; Francois-Noel Richard, Nancy, France

[73] Assignee: Vesuvius France S.A., 59750 Feidnies, France

[21] Appl. No.: 08/860,555

[22] PCT Filed: Oct. 25, 1996

[86] PCT No.: PCT/EP96/04640

§ 371 Date: Sep. 23, 1997

§ 102(e) Date: Sep. 23, 1997

[87] PCT Pub. No.: WO97/15410

PCT Pub. Date: May 1, 1997

[30] Foreign Application Priority Data

Oct. 27, 1995 [FR] France ..... 95 12912

[51] Int. Cl.[6] ..... B22D 41/28

[52] U.S. Cl. ..... 222/590; 222/600; 266/236; 266/DIG. 1

[58] Field of Search ..... 222/590, 600, 222/591; 266/45, 236, DIG. 1

[56] References Cited

U.S. PATENT DOCUMENTS

| | | | |
|---|---|---|---|
| 4,627,147 | 12/1986 | Kagi | 222/600 |
| 5,174,908 | 12/1992 | King et al. | 222/600 |
| 5,188,743 | 2/1993 | King | 222/600 |
| 5,211,857 | 5/1993 | Brinker | 222/600 |

*Primary Examiner*—Scott Kastler

*Attorney, Agent, or Firm*—Arthur L. Plevy; Greenbaum, Rowe, Smith, Ravin, Davis & Himmel LLP

[57] ABSTRACT

Process for reusing the plates of a slide gate for a metallurgical container. The gate has an upper indentation and a lower indentation for receiving a set of two refractory plates, each of these plates resting in an indentation by a face that becomes its support face and cooperating with the other plate by a face that becomes its characterized sliding face. A set of refractories comprised of a new plate associated with a plate that had been used once is used in the slide gate (2), and in that when the plates (12, 16) are changed the new plate is mounting in a lower or upper charging indentation (14, 18), this indentation remaining the same at the same at each plate change, the plate used once being mounted in the other indentation, which forms a recycling indentation.

21 Claims, 6 Drawing Sheets

PROCESS FOR REFUSING SLIDE GATE PLATES AND PLATE FOR THIS CLOSURE

The present invention concerns a process for reusing slide gate plates for a metallurgical container, especially a steel making ladle. It also concerns a plate for this closure, and the closure itself.

To control the flow of molten steel through the bottom of a metallurgical container such as a steel making ladle, a slide closure is generally used. It involves an upper fixed refractory plate connected by a generally joint cemented to an internal nozzle located in the thickness of the refractory that covers the wall of the bottom of the metallurgical container, and a mobile lower plate connected to a collecting nozzle or to a jet protection tube, also through a generally cemented joint.

These plates wear rapidly such that it is necessary to replace them frequently. In order to reduce the cost of refractories per ton of steel cast, it is known to use the same plates several times, possibly after cleaning or reconditioning. For example, the patent Stopinc GB 2.625.928 accessorily describes a plate with two pouring holes, rectified on its two faces and equipped with a metal bandage. This plate is turned upside down and reused.

However, a problem that is posed in the familiar processes is that of human management. The operator does not know how many times the plates have been reused. The information should be stored; the history of the plates should be noted. This necessitates a monitoring of the plates, which is difficult. The efficacy of recycling is reduced.

Furthermore, a plate has been used has damaged zones, e.g., eroded and abraded zones. Its reuse introduces risks, e.g., of the infiltration of metal between the two plates. Reuse of the plates, advantageous in the sense that is lengthens the service life of the refractories, also involves the disadvantage of introducing risks.

The present invention proposes a process for reusing slide gate refractory plates, the closure having an upper indentation and a lower indentation for receiving a set of two refractory plates, each of these plates resting in an indentation through a face that becomes its support face and cooperating with the other plate through a face that becomes its sliding face.

This process permits a simple management of the plates and it also permits prolonging the service life of the refractories by reducing the risks associated with this prolongation.

It is characterized in that a set of refractories comprised of a new plate associated with a plate that has been used only once in the slide closure, and in that during the changing of the plates, the new plate is mounted in a lower or upper loading indentation, this indentation remaining the same for each plate change, the plate used once being mounted in the other indentation (recycling).

This process thus defines a charging indentation of new plates, always the same, and a charging indentation of plates used only once, also always the same. Thus, the management of the plates is simple. During a reconditioning of the slide gate the operator knows, in view of the indentation in which it was placed, which is used for the first time and which should be recycled, and which plate has been used for the second time and should be discarded.

The operator systematically discards the recycled plate and keeps the plate that has been used once in an appropriate place so that it can be recycled. He then systematically mounts a new plate in the charging indentation, always the same, of new plates and a recycled plate in the other indentation.

Furthermore, this process is very reliable. In effect each plate is used twice and only twice;

each face of the plate is used as a slide face once and only once the sliding surfaces are systematically new;

two reused plates are never simultaneously present in the slide closure. A set of two recycled plates is thus never used.

According to a preferred embodiment, the plate used once is placed in the recycling indentation such that the face that was its support face during its first application becomes its sliding face.

Depending on the casting mode used, it can be of interest to mount the new plate either in the upper position or in the lower one.

According to one embodiment, the new plate is mounted as the lower plate and the reused plate is the upper plate.

Thus, closure and regulation is always with a new plate. Security is optimal because the lower plate is important for the closure of the pouring orifice.

According to another embodiment, the new plate is used as a upper plate. Thus, the joint between the internal nozzle and the plate is made on new surfaces.

The invention also concerns a refractory plate designed to be mounted in an indentation of a slide closure for a metallurgical container such as a ladle or a tundish, this slide closure having an indentation for the upper plate and an indentation for the lower plate.

The plate is characterized in that it has an aligning device that permits it to be mounted in only one position in the upper indentation, and in a single position in the lower indentation such that the support face of the plate becomes its sliding face when the plate passes from one position to the other.

Thus, when the recycled plate is mounted, one is certain that it is placed correctly, that is, so that its support face becomes its sliding face and vice versa. On the other hand, one is not certain that the plate will not be reused a second time in the same position. For this reason the invention also concerns a plate characterized in that it has a means that prevents its mounting a second time in the indentation reserved for slide gate plates, without preventing its mounting in the indentation reserved for recycled plates.

In one embodiment, this means is comprised of an element capable of projecting out under the effect of a physical phenomenon engendered by the pouring of molten metal, for example, the temperature or the thermal expansion.

According to one embodiment, the means that prevent mounting it more than once are comprised of a deformed piece of material with a shape memory capable of regaining an original shape after having been brought to a certain temperature.

According to another embodiment, the means that prevent mounting the plate more than once in an indentation are comprised of a mobile element seated in the plate and mechanically latched, this latching being eliminated or broken during the introduction of a new plate in the indentation for new plates, which causes the exit of the mobile element. For example, a clip retains a slug held in a seat and acted upon by a spring in leaving this seat, the clip being ejected during the initial placement of the plate.

According to another embodiment, the means that prevents mounting the plate more than once in an indentation of new plates is constituted by a deformation impressed on one part of the plate when it is introduced into the indentation of new plates. For example, a tongue is rolled up after the initial placement of the plate in the indentation of new plates of the closure, the second indentation having a seat capable of receiving the tongue after it is rolled up.

The plate is possibly ringed or has a metal envelope. In this case, its smaller face is at least equal to 60% of the other face. It can have two or more tapholes.

The invention also concerns a slide gate for a metal container that has an indentation for an upper plate and an indentation for a lower plate, characterized in that these indentations have a form such that they cannot accept an upper plate and a lower plate equipped with an aligning device in only one position.

The invention also concerns a slide gate having an indentation for an upper plate and an indentation for a lower plate, characterized in that only one of these indentations has a recess that permits the acceptance of a reused plate equipped with means that prevents mounting more than once in the same indentation of the slide gate.

The operator is thus forced to mount a new plate in the indentation that does not have a recess. The risk of utilizing a used plate instead of a new plate is suppressed.

In another variant of the invention, the plate has a two-position key, the first position of the key preventing the mounting of the plate in an indentation of new plates, the passage of the key from the first position to the second one being obtained by a notably thermal or mechanical effect, or by a material with a form-memory. One is thus certain that the set of plates will be comprised of a new plate and a used plate.

Other characteristics and advantages will be manifested in reading the following description of exemplary embodiments that are provided by means of illustration with reference to the attached Figures.

FIG. 1 is a cross-sectional view of a slide gate and can be equipped with plates conforming to the present invention.

FIGS. 2*a*, 2*b* and 2*c* present three stages of the invention process.

Figure 1:
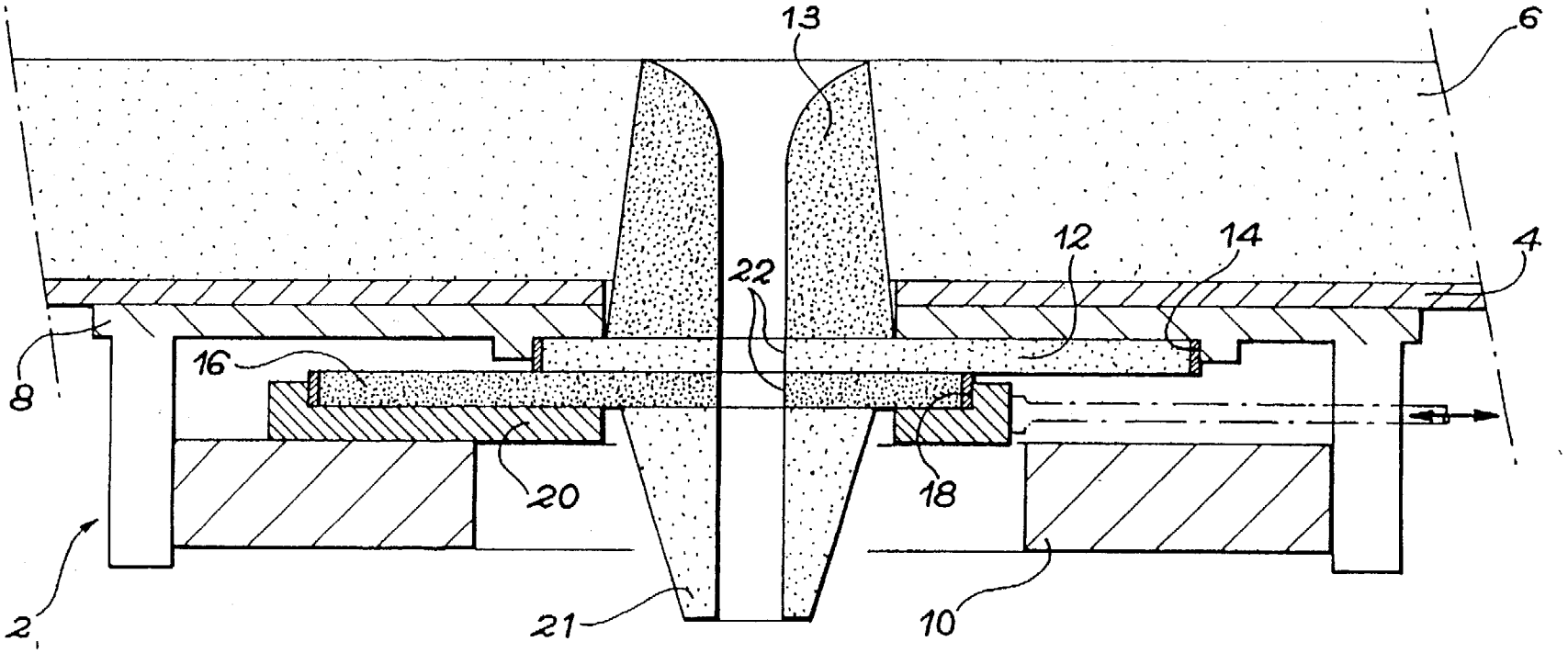

FIG. 1 shows a cross-sectional view of a slide gate for a metallurgical container such as a steel-making ladle or a distributor. The gate 2 is mounted under a bottom wall 4 covered with a layer of refractory material 6. The slide gate has a fixed underframe 8 mounted under the plate 4 and a door 10 that can be mounted to pivot relative to the fixed underframe 8. A fixed upper plate 12 is mounted in an indentation 14 of the upper underframe 8. A lower mobile plate 16 is mounted opposite the fixed plate 12. The plate 16 is seated in an indentation 18 or a slide 20. The slide 20 can be displaced in a known manner relative to the fixed part of the slide gate in order to regulate or stop the flow of molten metal.

The upper fixed plate 12 is connected to an internal nozzle 13 that passes through the layer of refractory material 6 and has an axial channel for the passage of the molten metal.

The mobile lower plate 16 is connected to a collecting nozzle 21. The two plates are symmetrically identical.

Each of the fixed 12 and mobile 16 plates has a circular hole 22 for the passage of molten metal.

In the exemplary embodiment shown the plates 12 and 16 are ringed. In a variant, these plates could also be surrounded by a metal envelope in a known manner, or have neither ringing nor metal envelope. The plates 12 and 16 have identical plane faces. These faces are not distinguished from each other when they are not mounted in the slide gate. On the other hand, when the plates have been put in place, they each have a support face with which they rest on the bottom of the indentation in which they are seated (upper indentation 14 or lower indentation 18). Each plate also has a sliding face, also called a working face. During pouring, these working faces makes it possible to regulate the flow of metal. They rub permanently against each other and wear rapidly. Consequently, it is necessary to change them frequently.

According to the invention process, a new plate is systematically mounted in the lower indentation 18 of the slide 20. After being used only once, the lower plate 16 is recovered and mounted in the indentation 14 of the upper underframe 8. It is positioned so that the face that was the working face when it was positioned in indentation 18 becomes its support face in the upper indentation 14. Reciprocally, the face that was its support face becomes its sliding or working face. This face is new in the sense that it was never used as a sliding face. The portion of it that surrounds the taphole was utilized to effect a joint with the nozzle 21, but no wear occurs on the surface in question.

The upper plate 12 that had already been used once as the lower plate is simply discarded. For the orifice of metal passage 22 of the lower plate 16 to be located opposite the axial channel of the internal nozzle 13, it is necessary to pivot it 180° in the horizontal plane since the hole 22 is off-centered relative to the plate.

FIGS. 2*a*, 2*b* and 2*c* illustrate the successive stages of the reutilization process according to the present invention. In FIG. 2*a* plate A is the upper plate and plate B is the lower plate before the metal is poured. The face of the plate A that had already been used is indicated by hatching 24. This face serves as the support face in the indentation 14 (see FIG. 1). The other face of plate A constitutes its working face. It had never been used. The lower plate B is new, none of its faces have been used. FIG. 2*b* shows the plates A and B after one cycle of pouring, e.g., some dozen ladles, before these plates had been replaced. The two faces of the upper plate A have been used, as indicated by the hatchings 24 and 26. Only one face of the lower plate B has been used, its upper face in the example shown, as indicated by the hatching 28.

Plate A is discarded and plate B is mounted as the upper plate. A new plate C is mounted as the lower plate. The situation is then as shown in FIG. 2*c*, which is identical to that shown in FIG. 2*a*, with the sole exception that plate B occupies the position that was that of plate A in FIG. 2*a* and plate C the plate that was that of plate B. The cycle thus continues in the same manner.

Figure 2:
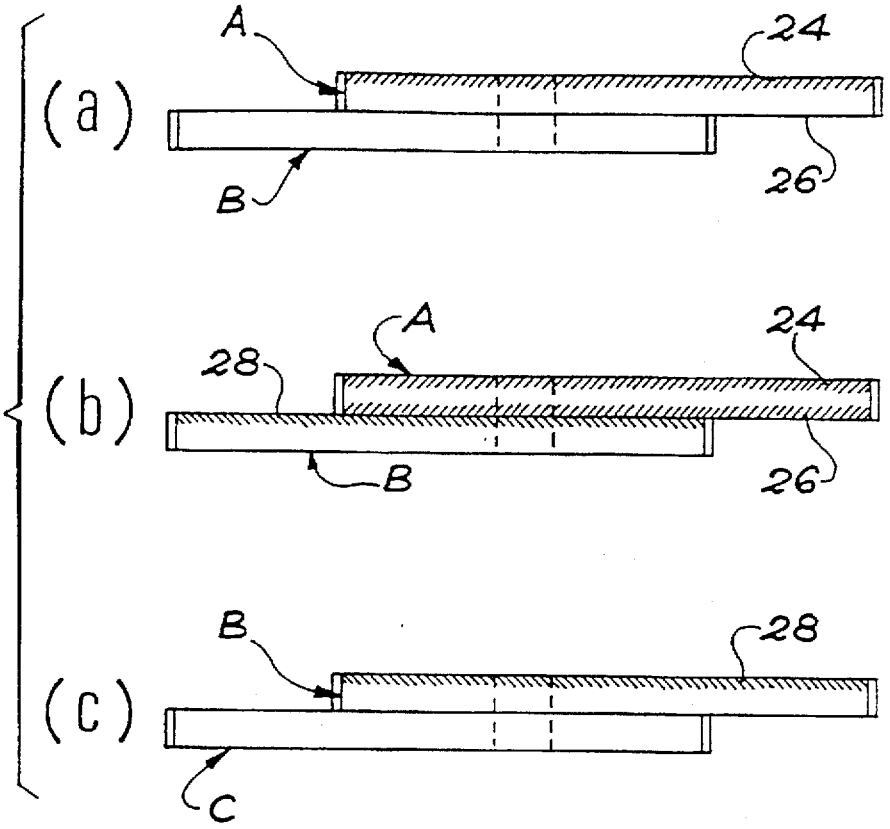

In the example described with reference to FIGS. 1 and 2, a new plate is placed in the lower position. However, it is also possible according to the invention to place the new plate in the upper position and then reuse it as the lower plate. The lower place undergoes a more intense erosion because it laminates or flattens the metal. This is why the upper plate is less eroded than the lower plate.

Figure 3:
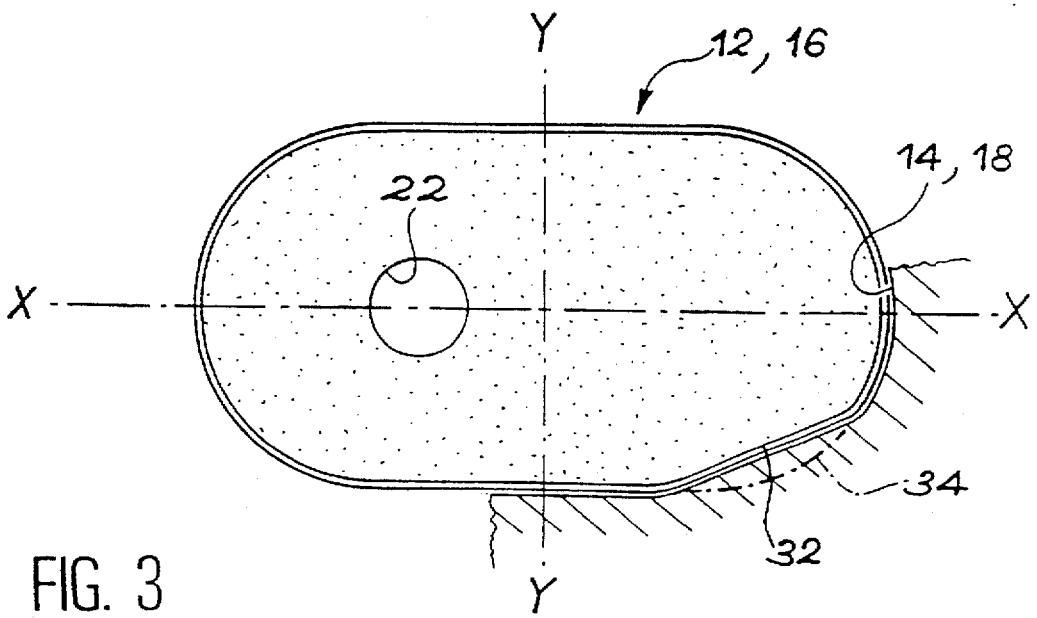
FIG. 3 is a top view of a plate according to the invention and having an aligning device.

FIG. 3 shows a top view of a plate according to the present invention, which has an aligning device. This plate has a circling 30. The aligning device is comprised of a cut panel 32. The plate is thus asymmetric relative to each of its axes XX and YY. The profile of the plate in the absence of a cut panel is designated by 34. Reference numeral is 14 and 18 indicate the form of the upper or lower indentation. As can be seen, this form follows the periphery of the plate at the level of the cut panel 32 so that the latter can be mounted only in a single position.

Of course, the position of the plate in the upper indentation is different from its position in the lower indentation, such that the support face of the plate becomes its working face.

However, in the mode of implementation shown in FIG. 3 there is nothing to prevent mounting an already used plate instead of a new plate in the lower indentation. The implementation mode of FIGS. 4 and 5 remedies this shortcoming.

Figure 4:
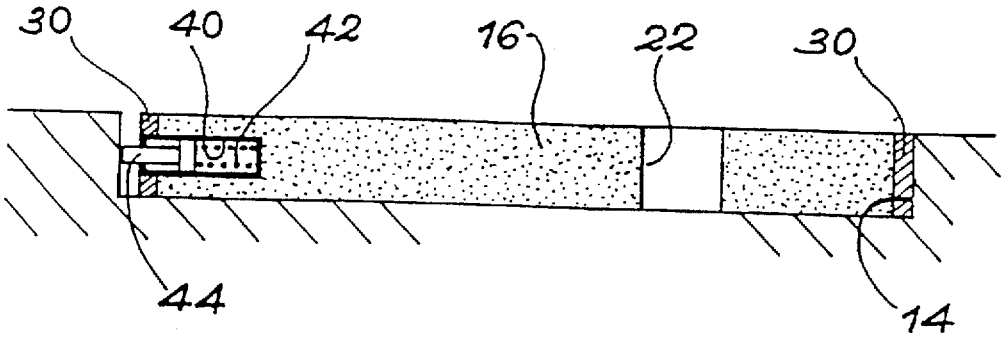
FIG. 4 is a cross-section view of a plate according to the present invention and having a means for preventing a mounting more than once in the same indentation.

FIGS. 4 shows a cross-sectional view of a preferred mode of implementation of a plate according to the invention. This plate has a means for preventing the mounting more than once in one of the indentations 14 or 18 of the slide gate. In the example shown this means is comprised of a slug 40 and a spring 42 that is capable of forcing the slug 40 out of a recess 44 provided in the thickness of the plate 12 or 16. The slug 40 is retained by a thermofusible substance. During the pouring of steel, under the effect of the heat of the molten metal, the plate 16 is heated and the thermofusible element melts, which frees the slug 40. The slug 40 then comes in contact with the indentation (the indentation 14 in the example shown on FIG. 4). When the plate 16 is removed from this indentation, the slug 40 projects out completely and prevents the placement of the plate 16 in the indentation 14 a second time.

Figure 5:
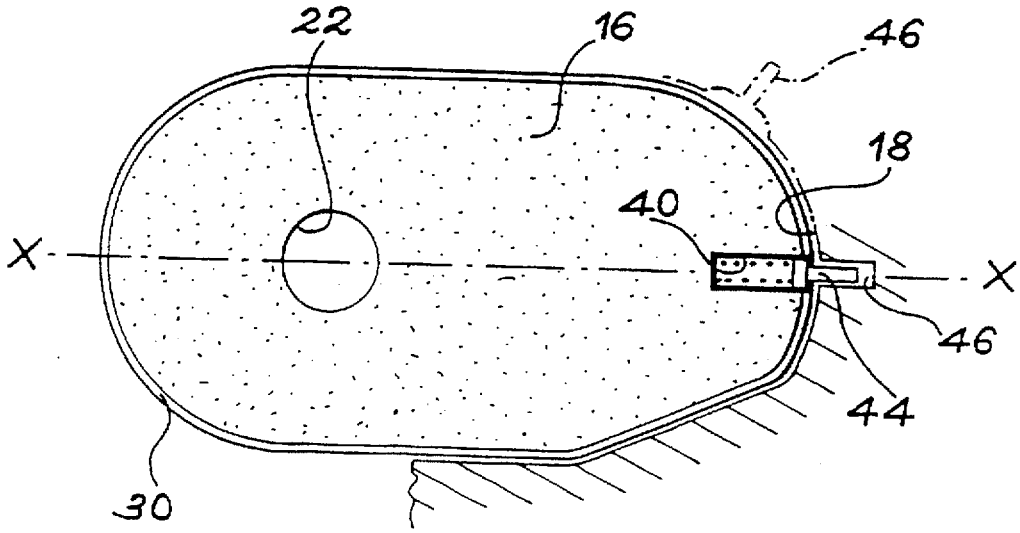
FIG. 5 is a top view of the plate shown in FIG. 3 after an initial use.

On the other hand, the upper indentation 18 has a slot 46 capable of accepting the slug 40 (see FIG. 5). The plate 16 can then be mounted without difficulty in this indentation after pivoting 180° in the horizontal plane.

Thanks to this device, the operator is systematically forced to mount a new plate in the desired indentation, the lower indentation 14 in the example described in FIG. 4. On the other hand, there is nothing to prevent the simultaneous mounting of two new plates, e.g., if there should not be any used plates.

The means that prevents mounting the plate more than once in the same indentation can be situated on the longitudinal axis XX of the plate, as in FIGS. 4 and 5. However, it is preferably located outside of this axis so that the plate is asymmetric relative to each of its axes XX and YY. In this manner, the means can also play the role of aligning device shown in FIG. 3. For example, when the plate is new, it projects out so as to penetrate into a shallow recess in the lower indentation. After an initial use of the plate, the slug moves out more and can no longer enter into the recess of the lower indentation. On the other hand, the recess 46 of the upper indentation is sufficially deep to receive it.

Figure 6:
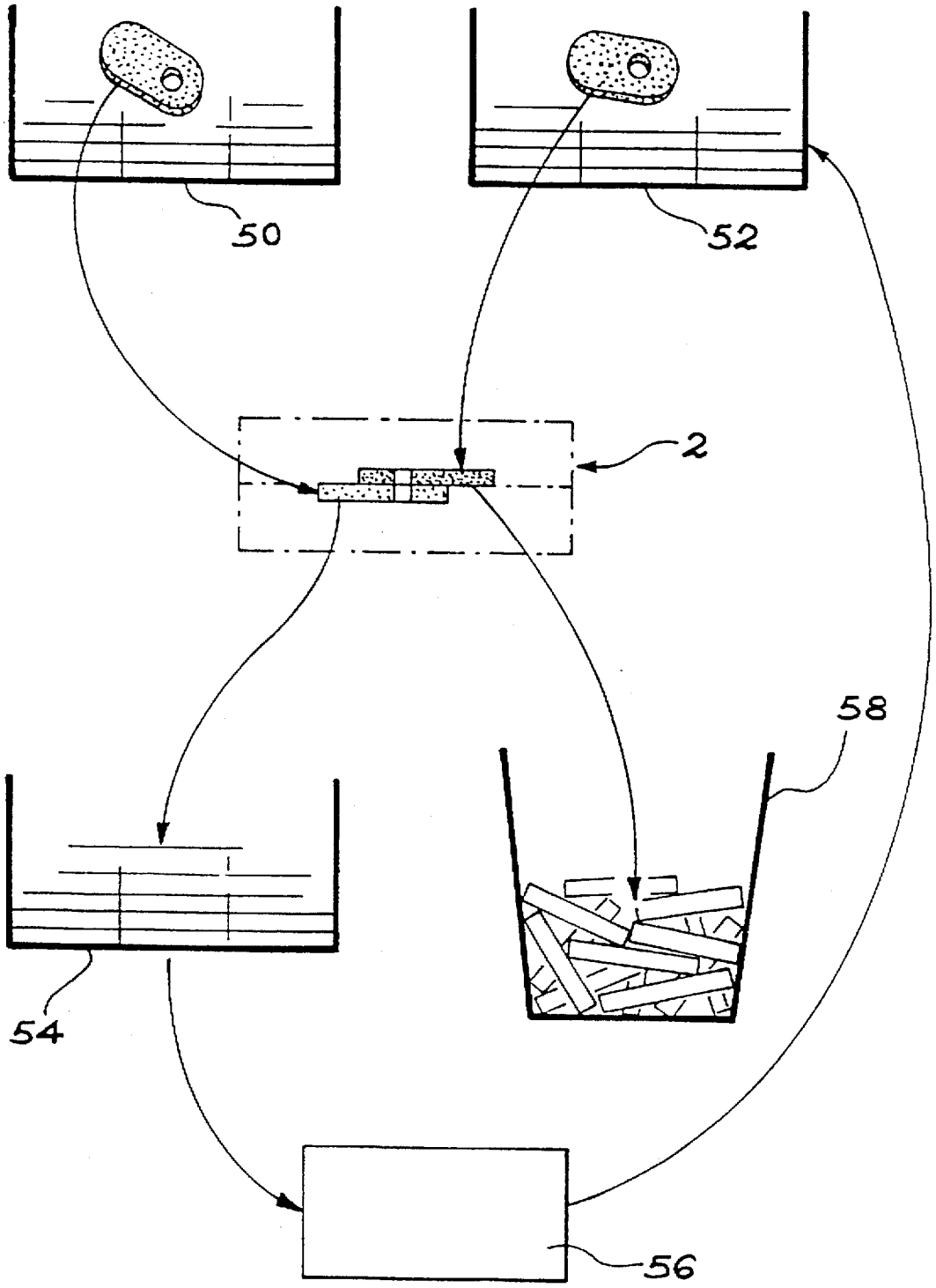
FIG. 6 shows the circulation of the plates.

The circulation of the plates is shown in FIG. 6. A box 50 contains new plates, which are mounted in the lower indentation of the gate 2. The box 52 contains plates that were used a single time. These plates are mounted in the upper indentation of the gate 2. The gate is then ready for a pouring cycle.

After pouring, the gate is opened and the plates are withdrawn. The lower plate, used once, is recovered in the box 54. It is given a cleaning in 56, and then goes into box 52. The upper plate, which was used twice, is discarded into the garbage can 58.

The invention plate can also have more than one hole, e.g., two. This offers the advantage of having a new pouring hole when the plate is reused. The surfaces that produce the joint with the internal nozzle and with the collecting nozzle respectively are also new. The cleaning of the plate is facilitated. The plate can be reused so that its old support face becomes its sliding face and vice versa. But the same face can also be reused as the support face or as the sliding face provided these are different working zones of the plate.

Figure 7:
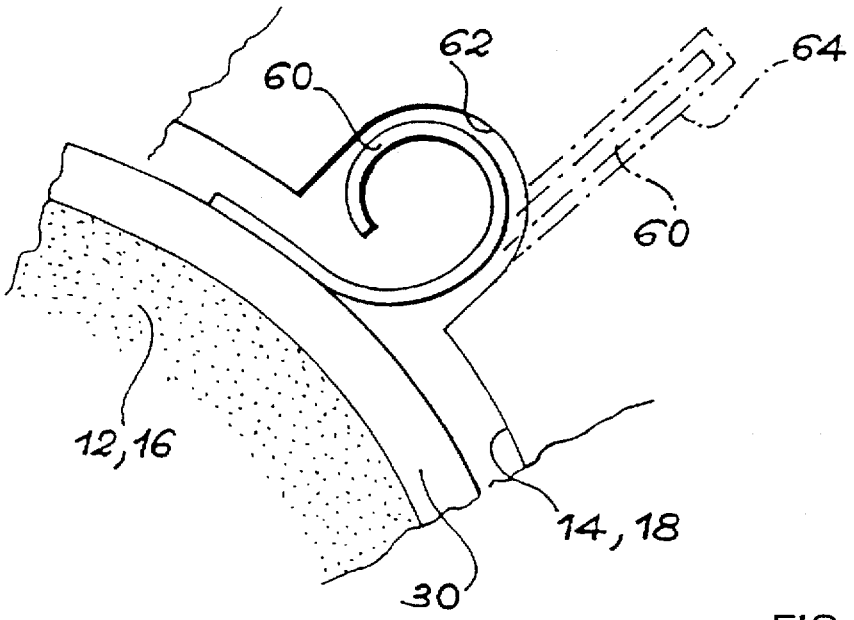
FIGS. 7, 8, 9, 10 and 11 show different means for preventing the mounting of a plate more than once.

FIG. 7 shows a first implementation variant of a means of device that prevents the mounting of more than one refractory plate according to the invention more than one in a lower or upper indentation. The plate 14 or 16 having the ringing 30 is equipped with a tongue 60 comprised of a metal with a form-memory. It is known that a form-memory metal is capable of resuming its initial form when it is heated to a certain temperature (e.g. 100° C.) after having been deformed. Initially, the tongue 60 presented an essentially rectilinear form as indicated by dotted lines. It was curved, as indicated by solid lines, to be able to penetrate into a recess 62 of the upper or lower indentation 14 and 16. During pouring, the plate is heated to a temperature above 100° C. so that the curved tongue 60 resumes its initial form as indicated by dotted lines as soon as it is extracted from the indentation. It can then no longer be reintroduced a second time into this indentation. It should necessarily be mounted in the other indentation that has a recess 64, shown with dotted lines and which is capable of accepting the tongue 60 in its rectilinear form.

Figure 8:
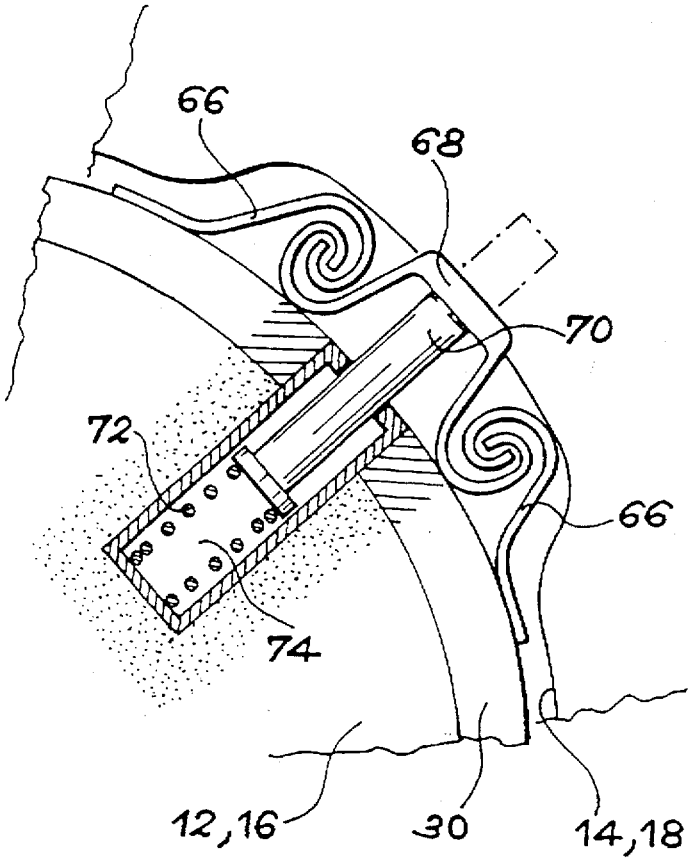

FIG. 8 shows a second implementation mode. Two tabs or fasteners 66 that are curved at their ends of the tab 66. A slug 70 mounted in a seat 74 of the plate 12 or 16 is acted upon by a spring 72 that tends to force it out of the seat 74. When the plate is new, the slug 70 is retained by the clip 68 and cannot move out of the seat 74. When the plate is mounted in one of the lower or upper indentations, the clip 68 is ejected so that the slug 70 butts against the wall of the indentation 14 or 18. As soon as the plate is removed from this indentation, the slug 70 projects out to assume the position indicated by dot-dash lines. The plate can then no longer be reintroduced a second time into the same indentation and has to be mounted in the other indentation that has a seat designed to receive the slug 70 in its fully extend position.

Figure 9:
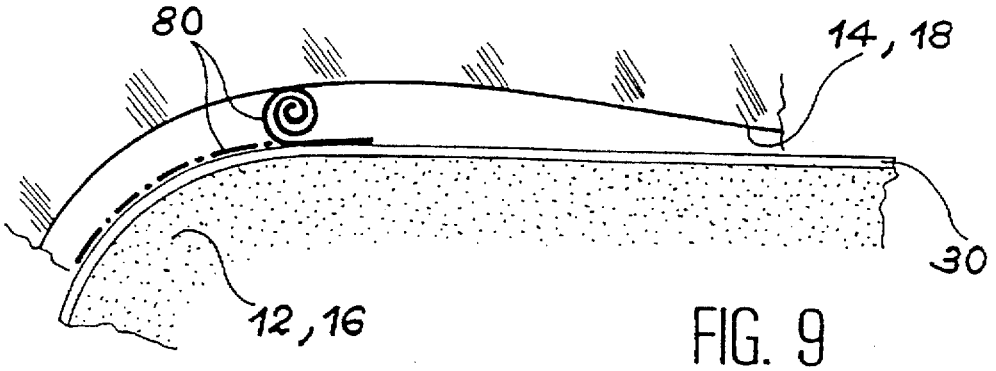
Figure 10:
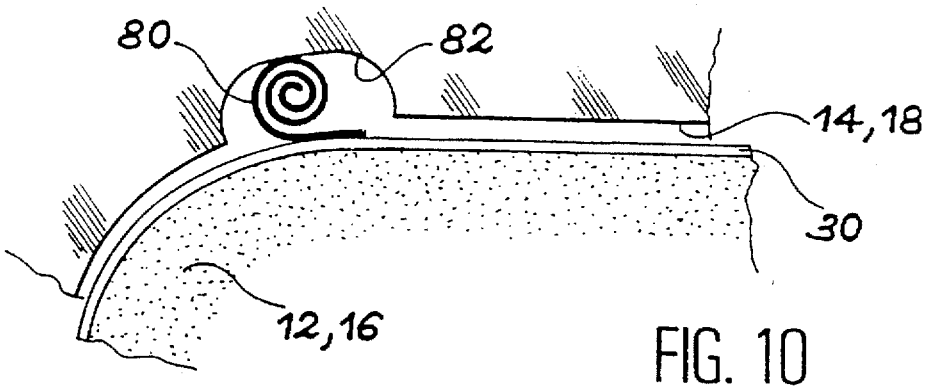

FIGS. 9 and 10 show a third implementation variant of the means that prevent mounting a plate more than once in the same indentation. This means is comprised of a tongue 80 fixed on the periphery of the ringing 30 of the plate. Initially, the tongue has an essentially rectilinear form as indicated by dotdash lines in FIG. 9. When the new plate was introduced into the indentation, the tongue 80 is rolled up, for example, by means of a tool analogous to the key of a sardine can. Rolling up the tongue makes it possible to bind the plate in the indentation. The tongue thus plays a dual role. It prevents mounting the plate more than once in the indentation and at the same time it serves to lock in the plate.

When the plate is removed from the first indentation, the tongue 80 which was compressed is readily released so that it can no longer be reintroduced into the same indentation. The other indentation has a seat 82 that is capable of receiving it.

Figure 11:
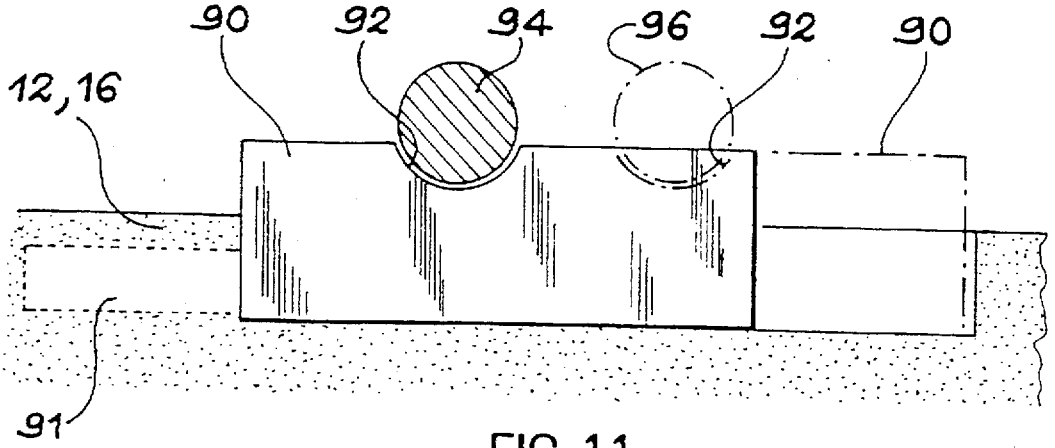

A fourth variant is shown in FIG. 11. A key 90 is provided in the plate 12, 16. This key has a recess 92. It can be displaced between a fist position (solid lines) and a second position (dot-dash lines) under the effect of an actuating mechanism 91 that is not indicated in detail but which can employ the principles described previously. In the first position of the key, a slug 94 mounted in the indentation of new plates falls opposite the recess 92 when the operator sets the plate in place. The plate can then be mounted in this indentation.

In the second position of the key 9, a slug 96 mounted in the indentation of recycled plates drops opposite the recess 92 when the plate is presented.

On the other hand, in the first position of the key the plate cannot be mounted in the indentation of recycled plates, and in the second position of the key, the plate cannot be mounted in the indentation of new plates. It is thus assured that there is always a set of plates comprised of a new plate and a recycled plate.

We claim:

1. A process for the reuse of plates of a slide gate for a metallurgical container, the gate having an upper indentation and a lower indentation for receiving a set of two refractory plates comprising a new plate and a plate that has been once-used, comprising steps of:

mounting each of said plates in said slide gate in spatial relation to one another to define an upper plate and a lower plate, each of said plates having a first surface resting against a corresponding one of said indentations defining a support face, and a second surface opposite said support face in cooperation with said second surface of said other plate defining a sliding face;

utilizing said new and once-used plates during a process charge cycle, wherein said plates become one-used and twice-used charge plates respectively;

changing said charged plates, comprising the steps of mounting a new plate in a lower or upper charged indentation, said indentation remaining the same in each charged plate, discarding said twice-used charged plate; and mounting said once-used charge plate in said other indentation, which constitutes a recycling indentation.

2. The process according to claim 1, wherein the plate used only once is placed in the recycling indentation so that the face that was its support face in its first utilization becomes it sliding face.

3. The process according to claim 1, wherein the new plate is used as the lower plate.

4. The process according to claim 1, wherein the new plate is used as the upper plate.

5. A refractory plate for mounting in an indentation (14, 18) of a slide gate for a metallurgical container, said refractory plate having a first surface in contact with said indentation defining a support face, and a second surface opposite said first surface defining a sliding face, the slide gate having an indentation (14) for receiving an upper plate and an indentation (18) for receiving a lower plate, said refractory plate interchangeably mountable within said upper indentation and said lower indentation and having an aligning device (32) that permits it to be mounted only in one position in the upper indentation and in only one position in the lower indentation, wherein the support face of the plate when said plate is in said upper indentation operates as the sliding face when the plate is in said lower indentation.

6. The refractory plate according to claim 1, wherein the aligning device includes a cut panel (32).

7. The plate according to claim 5 said plate further including prevent means for preventing mounting of said plate more than one time in each said indentations of the slide gate without preventing mounting for a first time in each said indentation (14, 18).

8. The plate according to claim 7 wherein the prevent means comprises an element (40) operable to project outward from said plate in response to a phenomenon engendered by the pouring of molten metal to prevent the placement of said plate in said indentation a second time.

9. The plate according to claim 8, wherein said element comprises a deformed piece (60) of form-memory material capable of resuming its original shape after having been brought to a certain temperature.

10. The plate according to claim 7, wherein the prevent means comprises a mobile element seated in the plate and mechanically locked, wherein said locking is eliminated during introduction of a new plate in the indentation of new plates, which induces the emergence of the mobile elements.

11. The plate according to claim 7, wherein said prevent means comprises a clip (68) that retains a slug (70) held in a seat (74) and induces to emerge from this seat, the clip operable to be ejected when the plate (12, 16) is out in place for the first time.

12. Please according to claim 7 wherein the prevent means comprises a deformation imposed on a portion of the plate when it is introduced into the indentation of new plates.

13. The plate according to claim 12, said prevent means further including a tongue (80) that is rolled up after the initial placement of the plate in an indentation of the gate, the second indentation having a seat (82) capable of receiving the tongue after it is rolled up.

14. The plate according to claim 5, wherein said plate is ringed.

15. The plate according to claim 5, further comprising a metal envelope surrounding said plate, wherein one of said support face and sliding face is at least equal to 60% of the other face.

16. The plate according to claim 7, said prevent means including a two-position key (90), the first position of the key preventing mounting of the plate in an indentation of new plates, the passage of the key (90) from the first position to the second position being obtained by a thermal or mechanical effort or by a form-memory material.

17. The plate according to claim 5, said plate further comprising two tap-holes (22).

18. A slide gate for a metallurgical container, said gate having a first indentation for an upper plate (12) and a second indentation for a lower plate (16), wherein said upper and lower plates are interchangeable within said first and second indentations, and wherein these indentations present a form such that they cannot receive an upper plate (12) and a lower plate (18) equipped with an aligning device (32) except in only one position.

19. A slide gate for a metallurgical container, having an indentation for an upper plate and an indentation for a lower plate, wherein only one of these indentations includes means (46) that permits receiving a reused plate and means that prevents mounting it more than once in the indentations of the slide gate.

20. In a slide gate for a metallurgical container having a first indentation for receiving an upper plate and a second indentation for receiving a lower plate, a refractory plate interchangeably mountable within said first and second indentations, said refractory plate having a first surface in contact with a corresponding one of said first and second indentations deforming a support face, and a second surface opposite said first surface defining a sliding face, said refractory plate including prevent means for preventing mounting of said plate more than one time in each said indentation and operative to align said plate within said slide gate.

21. In a slide gate for a metallurgical container having a first indentation for receiving an upper plate and a second indentation for receiving a lower plate, a refractory plate interchangeably mountable within said first and second indentations, said refractory plate having a first surface in contact with a corresponding one of said first and second indentations defining a support face, and a second surface opposite said first surface defining a sliding face, said refractory plate having an aligning device that permits it to be mounted only in one position in the upper indentation and in only one position in the lower indentation, and prevent means for preventing mounting of said plate more than one time in each said indentation of the slide gate without preventing mounting for a first time in each said indentation.

* * * * *